US005509708A

United States Patent [19]

Nathan

[11] Patent Number: 5,509,708

[45] Date of Patent: Apr. 23, 1996

[54] HANDLE FOR CARRYING OBJECTS AND SELF DEFENSE

[76] Inventor: Fried Nathan, 65, Ha-Tishbi Street, Haifa 34523, Israel

[21] Appl. No.: 291,563

[22] Filed: Aug. 16, 1994

[30] Foreign Application Priority Data

Aug. 17, 1993 [IL] Israel ..... 106712

[51] Int. Cl.[6] ..... B65D 33/06

[52] U.S. Cl. ..... 294/141; 294/137; 294/170

[58] Field of Search ..... 294/25, 137, 141–143, 294/146, 159, 170, 171; 2/16, 20, 21, 160, 163; 16/114 R, 114 B; 30/122, 298; 273/67 R, 67 B, 84 R; D22/117, 199

[56] References Cited

U.S. PATENT DOCUMENTS

| | | | |
|---|---|---|---|
| 1,468,848 | 9/1923 | Wear | 294/171 X |
| 2,099,447 | 11/1937 | Matsuyama | 273/84 R |
| 2,684,797 | 7/1954 | Schulte | 294/171 X |
| 3,679,103 | 7/1972 | Chmela et al. | 294/171 X |
| 4,004,722 | 1/1977 | Olivier | 294/171 |
| 4,096,629 | 6/1978 | Levine | 30/298 X |
| 4,160,369 | 7/1979 | Pearson | 273/84 R X |
| 4,890,355 | 1/1990 | Schulten | 294/171 X |
| 4,982,989 | 1/1991 | Sweeny | 294/171 |

FOREIGN PATENT DOCUMENTS

| | | | |
|---|---|---|---|
| 2541099 | 8/1984 | France | 294/170 |
| 4177096 | 6/1992 | Japan | 273/84 R |

*Primary Examiner*—Johnny D. Cherry
*Attorney, Agent, or Firm*—Lowe, Price, LeBlanc & Becker

[57] ABSTRACT

A handle made of a rigid material has an opening for insertion of four fingers of a user's hand, with nodules separating grooves spaced therein for the fingers. An outer bottom part of the handle has a row of nodules which serve as knuckles, to enable the user to defend himself or herself therewith against a physical attack. An outer upper part of the handle has a groove to receive and lift a handle portion of a bag and two hooks are provided at end portions of the handle for lifting bags thereby.

3 Claims, 1 Drawing Sheet

HANDLE FOR CARRYING OBJECTS AND SELF DEFENSE

The present invention relates to a handle for carrying objects and for self defense. More specifically, the handle according to the present invention is especially useful as a handle for carrying bags, baskets and different purses, and at the same time as a "knuckles" for self defense.

The number of property crimes involving violence to women, children and elderly people is rising in the past years around the world. Part of the crimes are attempts to grab bags while physically asaulting the victim. Many of the potential victims are devoid of any method of self defense against the attacker.

The purpose of the present invention is to help these potential victims of assault by giving them an assistance handle with a combined use as self defense and as a handle for carrying a bag or basket. The handle can be made of any rigid material such as metal, wood or any rigid plastic material.

The present invention relates to an assistance handle for the carrying of objects and for self defense made of a rigid material with a holding opening in it's center with means for threading or holding the handles of the objects and with nodules for personal defense against attackers along it's bottom part.

More specifically, the present invention relates to an assistance handle for the carrying of objects and for self defense made of a rigid material with a holding opening in it's center fitted in shape and size to the insertion of four fingers, a groove for threading and holding the handles of the objects which passes along the upper part of the handle. On either side of the handle are further carrying nodules curved as hooks also for the holding of carrying handles of objects, and a row of nodules for personal defense against attackers passes along the bottom part of the handle.

The holding opening in the center of the handle can be designed with bays and nodules fitted to fingers to be inserted into it, and which grab it. The groove which passes along the handle on it's upper part is used for the insertion and holding of handles, straps and holding strings of different kinds of plastic bags, baskets and purses. In the upper part of the groove, it is possible to add nodules to prevent the slipping out of the handles through the groove.

The present invention in it's preferred embodiment will be further described and clarified herein with FIGS. 1–4.

Figure 1:
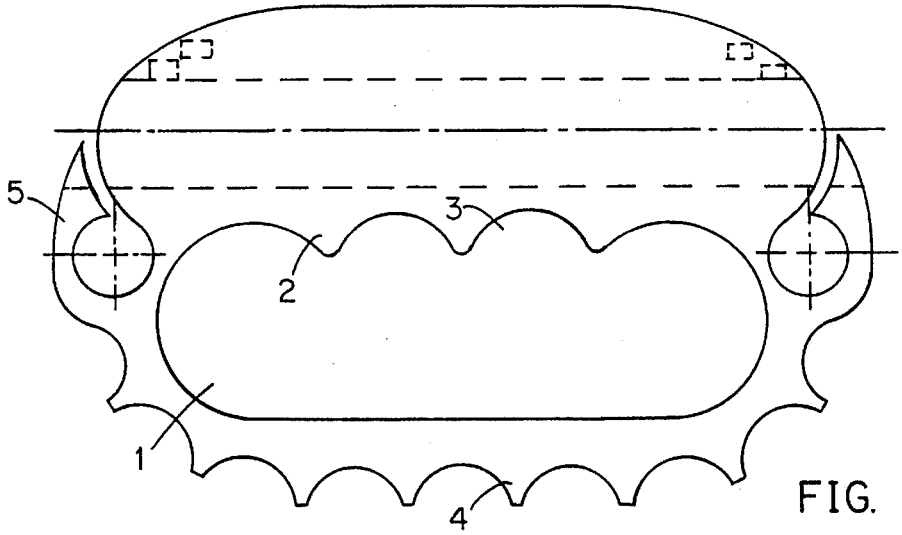

FIG. 1 describes a side view of the handle.

Figure 2:
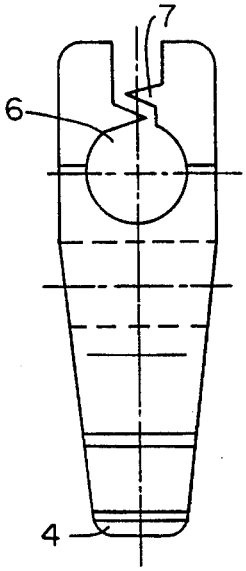

FIG. 2 describes a side view of the handle (from the narrow side).

Figure 3:
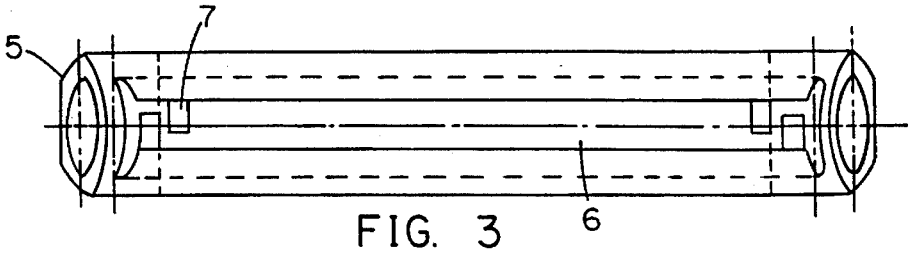

FIG. 3 describes a view from above the handle.

Figure 4:
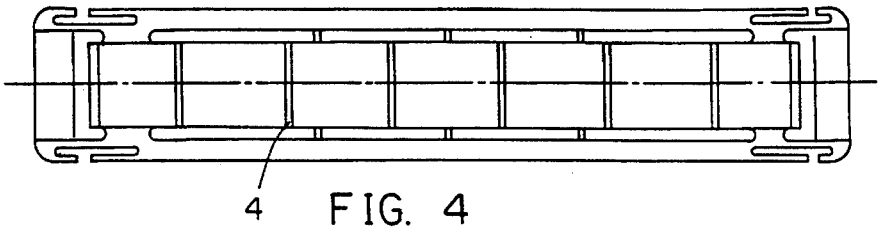

FIG. 4 describes a view from below the handle.

Following is a detailed description of the figures:

FIG. 1 describes a side view of the handle wherein in it's center is a holding opening (1) with nodules (2) and grooves (3) fitted to the shape of the fingers of the holding hand. The nodules (4) at the bottom of the handle, are used as a "knuckles" for self defense. The holding hooks (5) on the side are used for holding the baskets and purses with two handles, wherein into each hook one handle is inserted.

FIG. 2 describes the handle in side view (from the narrow side). A groove (6) passes along the upper part of the handle, allowing the insertion of the handles of a plastic bag or any other bag lengthwise. It is possible to add a nodule (7) or nodules in the upper part of the groove to prevent the handle slipping out. The defense nodules of the "knuckles" (4) are found on it's external bottom part, underneath the handle opening.

When somebody is attacked, he does not have to disconnect the bag from the handle, and can immediately use the handle as a "knuckles" even when the bag is still connected to the handle. As an alternative, if the victim has enough time, it is also possible to easily and quickly disconnect the basket or bag from the handle, and use the handle freely as a "knuckles".

FIG. 3 describes a view from above the handle. The groove (6) passes along the upper part of the handle. The nodules (7) in the upper part of the groove (6) prevent the handle slipping out. The holding hooks (5) are for holding baskets and purses with two handles.

FIG. 4 describes a view from below the handle. The row of nodules (4) are used as "knuckles" for self defense.

I claim:

1. An assistance handle for carrying objects and for self defense, comprising:

a body made of a rigid material and including an opening in the center thereof adapted to be grasped by the hand of a user;

means for attaching the objects to the body; and a plurality of nodules integral with and protruding from a bottom portion of the body to provide personal defense against attackers.

2. An assistance handle according to claim 1, further comprising at least one nodule disposed in an upper portion of the body to retain the objects in the handle.

3. An assistance handle for carrying an object including a handle and for self defense, comprising:

a body made of a rigid material and including an opening in the center thereof adapted to be grasped by the hand of a user, the opening including a contour;

a groove disposed in an upper part of the body for receiving the object handle;

a hook disposed on each side of the handle for securing the object handle in the groove; and nodules integral with a bottom portion of the body to provide personal defense against attackers.

* * * * *